US010194744B2

(12) United States Patent
Gonzalez et al.

(10) Patent No.: US 10,194,744 B2
(45) Date of Patent: Feb. 5, 2019

(54) SHELVING SUPPORT BRACKET ASSEMBLY

(71) Applicant: SPG International LLC, Covington, GA (US)

(72) Inventors: Arturo Gonzalez, Liburn, GA (US); Steven M. Kessell, Loganville, GA (US); Michael D. Potter, Marydel, DE (US)

(73) Assignee: SPG INTERNATIONAL LLC, Covington, GA (US)

( * ) Notice: Subject to any disclaimer, the term of this patent is extended or adjusted under 35 U.S.C. 154(b) by 0 days.

(21) Appl. No.: 15/678,909

(22) Filed: Aug. 16, 2017

(65) Prior Publication Data

US 2017/0340108 A1 Nov. 30, 2017

Related U.S. Application Data

(63) Continuation of application No. 14/840,254, filed on Aug. 31, 2015, which is a continuation of application (Continued)

(51) Int. Cl.
*A47B 57/48* (2006.01)
*A47B 96/06* (2006.01)

(Continued)

(52) U.S. Cl.
CPC ..... *A47B 57/485* (2013.01); *A47B 96/061* (2013.01); *A47B 96/1408* (2013.01); *A47B 57/00* (2013.01); *A47B 57/30* (2013.01)

(58) Field of Classification Search
None
See application file for complete search history.

(56) References Cited

U.S. PATENT DOCUMENTS 239,909 A 4/1881 Woodward
291,030 A 1/1884 Clapper (Continued)

FOREIGN PATENT DOCUMENTS

CN 1132999 10/1995
CN 101868166 A 10/2010

(Continued)

OTHER PUBLICATIONS

International Search Report and Written Opinion received in International Patent Application No. PCT/US2014/026525 dated Jul. 28, 2014 (11 pages).

(Continued)

*Primary Examiner* — Nkeisha Smith
(74) *Attorney, Agent, or Firm* — Michael Best & Friedrich LLP

(57) ABSTRACT

A shelving system includes a support post having a mounting surface and a plurality of vertically spaced retention members extending from the mounting surface. A shelf includes a bracket member configured for coupling to a first of the vertically spaced retention members. A support bracket includes an attachment portion configured for coupling to a second of the vertically spaced retention members adjacent the first vertically spaced retention member and a support portion configured for coupling to the bracket member.

19 Claims, 6 Drawing Sheets

Related U.S. Application Data

No. 13/830,962, filed on Mar. 14, 2013, now Pat. No. 9,119,471.

(51) Int. Cl.

| | |
|---|---|
| ***A47B 96/14*** | (2006.01) |
| *A47B 57/00* | (2006.01) |
| *A47B 57/30* | (2006.01) |

(56) References Cited

U.S. PATENT DOCUMENTS

| | | | | |
|---|---|---|---|---|
| 309,360 | A | | 12/1884 | Roberts |
| 663,784 | A | | 12/1900 | Porter |
| 870,439 | A | | 11/1907 | Kade |
| 1,424,284 | A | | 8/1922 | Dyke |
| 1,560,122 | A | | 11/1925 | Vance |
| 1,582,100 | A | | 4/1926 | Troppman |
| 1,620,841 | A | | 3/1927 | Vance |
| 1,698,974 | A | | 1/1929 | Vance |
| 1,702,937 | A | * | 2/1929 | Friedemann ..... A47F 3/12 248/242 |
| 1,983,858 | A | | 12/1934 | Karnes |
| 2,008,180 | A | | 7/1935 | Karnes |
| 2,246,090 | A | | 6/1941 | Filer |
| 2,263,282 | A | | 11/1941 | Welch et al. |
| 2,534,952 | A | | 12/1950 | Comer |
| 2,693,884 | A | | 11/1954 | Gurries |
| 2,772,846 | A | | 12/1956 | Skar |
| 2,788,949 | A | | 4/1957 | Gurries |
| 2,790,559 | A | | 4/1957 | Stephenson et al. |
| 2,912,119 | A | | 11/1959 | Robinson |
| 2,919,034 | A | | 12/1959 | Levy |
| 2,933,196 | A | | 4/1960 | Childs |
| 2,940,601 | A | | 6/1960 | Smith |
| 2,940,603 | A | | 6/1960 | Riedmaier et al. |
| 2,971,805 | A | | 2/1961 | Weiss |
| 2,975,908 | A | | 3/1961 | Huet |
| 2,983,389 | A | | 5/1961 | Trautmann |
| 3,018,900 | A | | 1/1962 | Huet |
| RE25,156 | E | | 4/1962 | Gingher et al. |
| 3,040,905 | A | | 6/1962 | Gingher et al. |
| 3,044,632 | A | | 7/1962 | Schild |
| 3,044,634 | A | | 7/1962 | Oztekin |
| 3,057,483 | A | | 10/1962 | Derman |
| 3,097,822 | A | | 7/1963 | Attwood |
| 3,100,572 | A | | 8/1963 | Gingher et al. |
| 3,127,146 | A | | 3/1964 | Fisher |
| 3,130,693 | A | | 4/1964 | Shell |
| 3,184,068 | A | | 5/1965 | Wende |
| 3,194,528 | A | | 7/1965 | Chesley |
| 3,199,822 | A | | 8/1965 | Ruhnke |
| 3,207,322 | A | | 9/1965 | Pedersen |
| 3,212,648 | A | | 10/1965 | Baker, Jr. et al. |
| 3,216,377 | A | | 11/1965 | Gunn |
| 3,221,678 | A | | 12/1965 | Doherty |
| 3,229,822 | A | | 1/1966 | Janus |
| 3,229,823 | A | | 1/1966 | Hummer |
| 3,250,584 | A | | 5/1966 | Tassell |
| 3,273,847 | A | | 9/1966 | Berman |
| 3,294,351 | A | | 12/1966 | Rollins, Jr. |
| 3,316,863 | A | | 5/1967 | Zock |
| 3,353,684 | A | | 11/1967 | Chesley |
| 3,355,134 | A | | 11/1967 | Chesley |
| 3,358,956 | A | | 12/1967 | Thornton |
| 3,371,798 | A | | 3/1968 | D'Altrui |
| 3,450,270 | A | | 6/1969 | Brown |
| 3,471,112 | A | | 10/1969 | MacDonald et al. |
| 3,479,975 | A | | 11/1969 | Ferdinand et al. |
| 3,495,718 | A | | 2/1970 | Romero |
| 3,512,654 | A | | 5/1970 | Olsen et al. |
| 3,517,623 | A | | 6/1970 | Goldstein et al. |
| 3,556,306 | A | | 1/1971 | Shell |
| 3,561,608 | A | | 2/1971 | Weider et al. |
| 3,565,020 | A | | 2/1971 | Schier |
| 3,565,381 | A | | 2/1971 | Oliver |
| 3,572,626 | A | | 3/1971 | Bertschi |
| 3,587,867 | A | | 6/1971 | Fenwick |
| 3,595,404 | A | | 7/1971 | Goldstein |
| 3,602,159 | A | | 8/1971 | Marschak |
| 3,602,374 | A | | 8/1971 | Alabaster |
| 3,612,291 | A | | 10/1971 | Skubic |
| 3,627,247 | A | | 12/1971 | Krikorian |
| 3,631,821 | A | | 1/1972 | Zachariou |
| 3,645,486 | A | | 2/1972 | Ferdinand et al. |
| 3,695,569 | A | | 10/1972 | Pullan |
| 3,701,325 | A | | 10/1972 | Fenwick |
| 3,730,108 | A | | 5/1973 | Stroh |
| 3,740,776 | A | * | 6/1973 | Lazarus ..... A47C 19/022 5/296 |
| 3,759,191 | A | | 9/1973 | Freeman |
| 3,765,344 | A | | 10/1973 | Ferdinand et al. |
| 3,784,025 | A | | 1/1974 | Dumit |
| 3,793,655 | A | | 2/1974 | Harris et al. |
| 3,827,377 | A | | 8/1974 | Aughtry, Jr. |
| 3,854,686 | A | | 12/1974 | Konstant |
| 3,885,675 | A | | 5/1975 | Hultenby et al. |
| 3,993,002 | A | | 11/1976 | Stroh |
| 4,018,167 | A | | 4/1977 | Spangler |
| 4,064,996 | A | | 12/1977 | Shillum |
| 4,098,480 | A | | 7/1978 | Neumann |
| 4,101,108 | A | | 7/1978 | Klein |
| 4,109,797 | A | | 8/1978 | Brunette |
| 4,116,509 | A | | 9/1978 | Smith |
| 4,122,955 | A | | 10/1978 | Celms |
| 4,146,140 | A | | 3/1979 | Suter et al. |
| 4,150,753 | A | | 4/1979 | Stahl et al. |
| 4,174,086 | A | | 11/1979 | Verberkmoes |
| 4,189,123 | A | | 2/1980 | Johnson |
| 4,190,002 | A | | 2/1980 | Redemann |
| 4,197,950 | A | | 4/1980 | Ovitz, III |
| 4,201,139 | A | | 5/1980 | Suttles |
| 4,205,815 | A | | 6/1980 | Sauer et al. |
| 4,230,052 | A | | 10/1980 | Champagne |
| 4,285,436 | A | | 8/1981 | Konstant et al. |
| 4,286,719 | A | | 9/1981 | Hall |
| 4,312,086 | A | | 1/1982 | Bianco |
| 4,332,204 | A | | 6/1982 | Hewell |
| 4,360,181 | A | | 11/1982 | Burkholder |
| 4,367,819 | A | | 1/1983 | Lewis |
| 4,378,925 | A | | 4/1983 | Griffin |
| 4,390,302 | A | | 6/1983 | Sanfeliu-Marimon |
| 4,396,125 | A | | 8/1983 | Rowader |
| 4,397,432 | A | | 8/1983 | Resetar |
| 4,444,323 | A | | 4/1984 | Travis |
| 4,455,007 | A | | 6/1984 | Varon et al. |
| 4,534,529 | A | | 8/1985 | Dorner |
| 4,589,349 | A | | 5/1986 | Gebhardt et al. |
| 4,592,286 | A | | 6/1986 | Trubiano |
| 4,615,503 | A | | 10/1986 | Garfinkle |
| 4,623,065 | A | | 11/1986 | Cooper |
| 4,624,376 | A | | 11/1986 | Bertram |
| 4,627,543 | A | | 12/1986 | Nicely |
| 4,684,094 | A | | 8/1987 | Everett |
| 4,700,916 | A | | 10/1987 | Bastian et al. |
| 4,938,442 | A | | 7/1990 | Mastrodicasa |
| 4,951,908 | A | | 8/1990 | Kallio |
| 4,960,210 | A | | 10/1990 | Spamer |
| D311,858 | S | | 11/1990 | Richmond |
| 5,022,541 | A | | 6/1991 | White |
| 5,054,404 | A | | 10/1991 | Melgers |
| 5,069,408 | A | | 12/1991 | Bessinger |
| 5,074,422 | A | | 12/1991 | Holtz |
| 5,080,238 | A | | 1/1992 | Hochman |
| 5,116,007 | A | | 5/1992 | Von Gunton et al. |
| 5,127,342 | A | | 7/1992 | Taylor |
| 5,161,701 | A | | 11/1992 | Berny |
| D331,873 | S | | 12/1992 | Finkelstein et al. |
| D333,059 | S | | 2/1993 | Cohn et al. |
| 5,205,630 | A | | 4/1993 | Welch |
| 5,221,014 | A | | 6/1993 | Welch et al. |
| 5,230,492 | A | | 7/1993 | Zwart et al. |
| D339,704 | S | | 9/1993 | Cohn et al. |
| 5,263,595 | A | | 11/1993 | Hilstolsky |
| 5,265,740 | A | | 11/1993 | Hodsden et al. |

(56) References Cited

U.S. PATENT DOCUMENTS 5,269,419 A 12/1993 Aldeguer et al.
5,288,046 A 2/1994 Eklof et al.
5,297,486 A 3/1994 Herrmann et al.
5,303,645 A 4/1994 Meacham
5,305,898 A 4/1994 Merl
5,346,077 A 9/1994 Randall
5,350,074 A 9/1994 Rosenband
5,351,842 A 10/1994 Remmers
5,365,860 A 11/1994 Billington, III
5,390,803 A 2/1995 McAllister
5,405,114 A 4/1995 Dias
D358,321 S 5/1995 Tayar
5,415,302 A 5/1995 Carlson et al.
5,417,396 A 5/1995 Merl
5,423,251 A 6/1995 Kolvites et al.
5,437,426 A 8/1995 MacDonald
5,443,167 A 8/1995 Menaged et al.
5,454,638 A 10/1995 Bird et al.
5,456,435 A 10/1995 Sweeney
5,456,438 A 10/1995 Long
5,472,103 A 12/1995 Merl
5,477,971 A 12/1995 Howard
5,482,168 A 1/1996 Welch et al.
5,509,541 A 4/1996 Merl
5,518,127 A 5/1996 Warmack et al.
5,522,324 A 6/1996 van Gelder et al.
5,531,168 A 7/1996 Towfigh
5,575,444 A 11/1996 Otema
5,592,886 A 1/1997 Williams et al.
5,605,238 A 2/1997 Jacobs
5,611,440 A 3/1997 Moller
5,613,449 A 3/1997 Pullman
5,641,081 A 6/1997 Merl
5,645,257 A 7/1997 Ward
5,647,650 A 7/1997 Daugherty et al.
5,655,740 A 8/1997 Lazarus
5,680,942 A 10/1997 McAllister et al.
5,695,163 A 12/1997 Tayar
5,715,957 A 2/1998 Merl
5,769,247 A 6/1998 Merl
5,794,902 A 8/1998 Henry et al.
5,797,501 A 8/1998 Von Gunten
5,797,503 A 8/1998 Stevens
5,806,820 A 9/1998 Simon
5,816,419 A 10/1998 Lamson
5,833,083 A 11/1998 Miller
5,868,263 A 2/1999 McAllister et al.
5,884,567 A 3/1999 Bartz, Jr.
5,908,119 A 6/1999 Kump et al.
5,915,803 A 6/1999 Daugherty
5,921,190 A 7/1999 Wood
5,921,411 A 7/1999 Merl
5,921,414 A 7/1999 Burke et al.
D415,365 S 10/1999 Nicklas
5,970,887 A 10/1999 Hardy
5,979,677 A 11/1999 Simpson, II et al.
6,017,009 A 1/2000 Swartz et al.
6,019,331 A 2/2000 Hoogland et al.
6,024,333 A 2/2000 Raasch et al.
6,029,833 A 2/2000 Yeh
6,053,115 A 4/2000 Felton
6,062,401 A 5/2000 Hall et al.
6,082,690 A 7/2000 Durin et al.
6,109,461 A 8/2000 Kluge et al.
6,116,436 A 9/2000 Ferrucci et al.
6,129,224 A 10/2000 Mingers
6,158,599 A 12/2000 Lazarus
6,182,937 B1 2/2001 Sanderse
6,230,907 B1 5/2001 Stuart
6,253,687 B1 7/2001 McAllister
6,267,064 B1 7/2001 Ostertag et al.
6,269,906 B1 8/2001 Dockter et al.
6,302,283 B1 10/2001 Yeh
6,345,795 B1 2/2002 Bartz, Jr.
6,431,090 B1 8/2002 Davis et al.
D462,541 S 9/2002 Welch
6,460,946 B1 10/2002 Beukema
6,481,678 B1 * 11/2002 Chong ..... H02G 3/288 211/192
6,555,740 B2 4/2003 Roth et al.
6,584,916 B1 7/2003 Felton et al.
6,625,935 B1 9/2003 King et al.
6,659,295 B1 12/2003 De Land et al.
6,666,344 B1 12/2003 Schneider
6,675,725 B2 1/2004 Felton et al.
6,726,035 B2 4/2004 Zadak
RE38,517 E 5/2004 Pfeiffer et al.
6,848,589 B2 2/2005 Wood
6,918,499 B2 7/2005 De Land et al.
6,932,225 B2 8/2005 Rowe
6,935,518 B2 8/2005 Winig et al.
6,971,528 B2 12/2005 Chen
7,040,494 B2 5/2006 Harper
7,086,543 B2 8/2006 Remmers
7,128,223 B1 10/2006 Sarnoff et al.
7,147,114 B2 12/2006 Sarnoff et al.
7,150,361 B2 12/2006 Calleja
7,191,907 B2 3/2007 Conway
7,191,908 B2 3/2007 De Rijk
7,240,803 B2 7/2007 Stitchick et al.
7,258,317 B1 8/2007 Nagel
7,284,671 B1 10/2007 Doscher
7,311,211 B2 12/2007 Chung
7,350,649 B1 4/2008 Martens
7,357,362 B2 4/2008 Yang et al.
7,378,213 B2 5/2008 Smalley
7,387,212 B2 6/2008 Costa et al.
7,387,213 B1 6/2008 Smalley
7,401,705 B2 7/2008 Craft
7,404,533 B1 7/2008 Kologe
7,407,060 B2 8/2008 Swartz et al.
7,494,019 B2 2/2009 Kessell et al.
7,497,344 B2 3/2009 Chen
7,506,772 B2 3/2009 Chen
7,523,903 B1 4/2009 Rindoks et al.
7,568,436 B2 8/2009 McAllister et al.
7,654,497 B1 2/2010 Karan
7,677,514 B1 3/2010 Palmer
7,762,411 B2 * 7/2010 Hilburn ..... H05K 7/1489 211/192
7,810,438 B2 10/2010 Ryberg
7,832,571 B2 11/2010 Felsenthal
7,900,783 B2 3/2011 Fernandez et al.
7,967,156 B2 6/2011 Hsu
7,967,268 B2 6/2011 Herron, III et al.
7,992,731 B2 8/2011 McAllister et al.
8,025,163 B2 9/2011 McAllister et al.
8,028,846 B2 10/2011 Peota et al.
8,087,521 B2 1/2012 Schwartzkopf et al.
8,113,678 B2 2/2012 Babcock et al.
8,118,181 B2 2/2012 Shinozaki
8,141,724 B2 2/2012 Northam et al.
8,152,119 B2 4/2012 Pfund et al.
8,235,339 B2 8/2012 Selvidge et al.
8,424,466 B2 4/2013 Botkin
8,468,844 B2 6/2013 Nagel et al.
8,584,873 B2 11/2013 Horn et al.
8,596,590 B2 12/2013 McCoy
8,602,372 B2 * 12/2013 Yu ..... H05K 7/1489 211/192
8,646,624 B2 2/2014 Fernandez et al.
D702,467 S 4/2014 Huang et al.
8,967,576 B2 3/2015 Knoll et al.
9,119,471 B2 9/2015 Gonzalez et al.
9,173,506 B2 11/2015 Andersson et al.
9,277,814 B2 3/2016 Winker
9,339,108 B2 5/2016 Zang et al.
9,770,122 B2 9/2017 Gonzalez et al.
D808,200 S 1/2018 Davis et al.
9,883,755 B2 2/2018 Gonzalez et al.
2002/0104938 A1 8/2002 Simard
2003/0037712 A1 2/2003 Welch et al.
2003/0160012 A1 8/2003 Kanouchi et al.
2003/0234231 A1 12/2003 Rowe

(56) References Cited

U.S. PATENT DOCUMENTS

| | | | |
|---|---|---|---|
| 2004/0020885 | A1 | 2/2004 | Newman |
| 2004/0045919 | A1 | 3/2004 | Remmers |
| 2004/0050814 | A1 | 3/2004 | Roush et al. |
| 2004/0154498 | A1 | 8/2004 | Borgen et al. |
| 2004/0159622 | A1 | 8/2004 | Craft et al. |
| 2004/0173549 | A1 | 9/2004 | Herron, III et al. |
| 2004/0182805 | A1 | 9/2004 | Harper |
| 2005/0045787 | A1 | 3/2005 | Magnusson |
| 2005/0056604 | A1 | 3/2005 | Chen |
| 2005/0092706 | A1 | 5/2005 | Chang |
| 2005/0103733 | A1 | 5/2005 | Saltzberg et al. |
| 2005/0103734 | A1 | 5/2005 | Saltzberg et al. |
| 2005/0127017 | A1 | 6/2005 | Kessel et al. |
| 2005/0145147 | A1 | 7/2005 | Costa et al. |
| 2005/0145588 | A1 | 7/2005 | Stitchick et al. |
| 2005/0150850 | A1 | 7/2005 | Stitchick et al. |
| 2005/0199568 | A1 | 9/2005 | Gay, II et al. |
| 2006/0054577 | A1 | 3/2006 | Strating et al. |
| 2006/0091088 | A1 | 5/2006 | McCoy |
| 2006/0175495 | A1 | 8/2006 | Gregory |
| 2006/0213849 | A1 | 9/2006 | Bienick |
| 2007/0110511 | A1 | 5/2007 | Chen |
| 2007/0114348 | A1 | 5/2007 | Nawrocki |
| 2007/0138362 | A1 | 6/2007 | McAllister et al. |
| 2007/0241072 | A1 | 10/2007 | Bryant et al. |
| 2007/0295681 | A1 | 12/2007 | Colin |
| 2008/0047914 | A1 | 2/2008 | Young |
| 2008/0083685 | A1 | 4/2008 | Chen |
| 2008/0128373 | A1 | 6/2008 | Chang et al. |
| 2008/0142463 | A1 | 6/2008 | Johnson |
| 2008/0179267 | A1 | 7/2008 | Johnson |
| 2008/0217496 | A1 | 9/2008 | Wooten |
| 2008/0237426 | A1 | 10/2008 | Walters |
| 2009/0014400 | A1 | 1/2009 | Nawrocki |
| 2009/0139943 | A1 | 6/2009 | Fernandez |
| 2010/0032394 | A1 | 2/2010 | Wang |
| 2010/0140202 | A1 | 6/2010 | Janis |
| 2010/0155353 | A1 | 6/2010 | McAllister et al. |
| 2010/0163504 | A1 | 7/2010 | Freeman |
| 2010/0200716 | A1* | 8/2010 | White, III ..... H05K 7/1489 248/243 |
| 2010/0327135 | A1 | 12/2010 | Selvidge et al. |
| 2011/0168651 | A1 | 7/2011 | Stenftenagel et al. |
| 2011/0220602 | A1 | 9/2011 | Chen |
| 2012/0175330 | A1 | 7/2012 | Nicholls et al. |
| 2012/0255924 | A1 | 10/2012 | Kologe |
| 2012/0273447 | A1 | 11/2012 | Stitchick et al. |
| 2012/0292271 | A1 | 11/2012 | Bevelacqua |
| 2013/0020272 | A1 | 1/2013 | Kropveld |
| 2013/0020452 | A1 | 1/2013 | Yu et al. |
| 2013/0021391 | A1 | 1/2013 | Rui |
| 2014/0263125 | A1 | 9/2014 | Gonzalez et al. |
| 2015/0335155 | A1 | 11/2015 | Winker |
| 2015/0366339 | A1 | 12/2015 | Gonzalez et al. |
| 2016/0015174 | A1 | 1/2016 | Guizzardi |
| 2017/0310090 | A1 | 10/2017 | Woodley et al. |
| 2017/0332782 | A1 | 11/2017 | Castro |
| 2017/0340108 | A1 | 11/2017 | Gonzalez et al. |
| 2017/0340142 | A1 | 11/2017 | Gonzalez et al. |

FOREIGN PATENT DOCUMENTS

| | | | |
|---|---|---|---|
| CN | 102131426 | A | 7/2011 |
| DE | 1138902 | | 10/1962 |
| DE | 2824605 | A1 | 12/1979 |
| DE | 9109395 | | 9/1991 |
| DE | 20215552 | U1 | 2/2003 |
| FR | 1515478 | | 3/1968 |
| GB | 608480 | A | 9/1948 |
| GB | 1025357 | | 1/1963 |
| GB | 1149568 | | 6/1967 |
| GB | 2194134 | | 3/1988 |
| KR | 101267731 | B1 | 5/2013 |
| WO | 9529613 | A1 | 11/1995 |
| WO | 03088782 | A2 | 10/2003 |
| WO | 2005046401 | | 5/2005 |
| WO | 2013071977 | A1 | 5/2013 |

OTHER PUBLICATIONS

Extended European Search Report for Application No. 14775083.0 dated Feb. 15, 2017 (8 pages).

First Office Action and Search Report from The State Intellectual Property Office of The People's Republic of China for Application No. 201480024336.X dated Dec. 28, 2016 (16 pages).

Extended European Search Report for Application No. 14775083.0 dated Jun. 21, 2017 (9 pages).

Metro, "Metro Cantilevered Freestanding Shelving System," article (2001) 5 pages, www.metro.com.

Eagle Group , "Cantilever Shelving," article, EG7010 Rev. 3 (2005) 4 pages, www.eaglegrp.com Modern Equipment Company, Inc., "Meco Omaha Cantilever Rack, Buyers Guide" online brochure (2001) 12 pages.

Modern Equipment Company, Inc., "Instructions for Assembling Meco Omaha Series 2000 Medium-Heavy Duty Cantilever Rack" online brochure (2013) 6 pages, www.meco-omaha.com.

EZ Shelving Systems, Inc., "Manufacturer of Space-Saving Cantilever Shelving & Hardware," catalog (2005) pp. 1-8, Merriam, USA website: www.e-shelving.com.

EZ Shelving Systems, Inc., "Manufacturer of Space-Saving Cantilever Shelving & Hardware," catalog (2008) pp. 1-4, Merriam, USA website: www.e-zshelving.com Second Office Action and Search Report from The State Intellectual Property Office of The People's Republic of China for Application No. 201480024336.X dated Aug. 21, 2017 (8 pages).

U.S. Appl. No. 15/675,368, filed Aug. 11, 2017, In re Arturo Gonzalez, entitled "Shelving System" (27 pages).

Office Action received in U.S. Appl. No. 15/675,368, dated Oct. 6, 2017 (7 pages).

Complaint for Patent Infringement, U.S. District Court, Middle District of Tennessee Nashville Division, *SPG International, LLC* v. *Intermetro Industries Corp*, Case No. 13:18-cv-00116, filed Feb. 8, 2018 (6 pages).

U.S. Appl. No. 15/886,636, filed Feb. 1, 2018, In re Arturo Gonzalez, entitled "Shelving System" (27 pages).

Defendant's Amended Answer and Counterclaims, U.S. District Court, Middle District of Tennessee Nashville Division, *SPG International, LLC* v. *Intermetro Industries Corp*, Case No. 13:18-cv-00116, filed Apr. 5, 2018 (18 pages).

Limited Warranty and Assembly Instructions, Nexel Industries Inc., believed to be available to the public before Mar. 14, 2013, (3 pages).

"Cantilever Shelving System," catalog, Nexel Industries Inc., believed to be available to the public before Mar. 14, 2013, Nexelwire.com, (1 page).

"Corrosion Resistant Cantilever Rack," website, Global Industrial, Nov. 18, 2011, globalindustrial.com, (2 pages).

"Corrosion Resistant Cantilever Rack Upright," website, Global Industrial, Oct. 17, 2011, globalindustrial.com, (3 pages).

"Storage and Handling Equipment," catalog, Nexel Industries Inc., Jul. 24, 2010, http://www.nexelwire.com:80/catalog/, (1 page).

"Shelf Types," catalog, Nexel Industries Inc., Sep. 28, 2010, (58 pages).

Statement of Relevance with photo of shelving system asserted by Defendant in *SPG International, LLC* v. *Intermetro Industries Corp*, Case No. 3:18-cv-00116 as a cantilever shelving system made by Nexcel Industries, Inc. and available to the public since at least about Oct. 2011, (2 pages).

Statement of Relevance with photos showing select components of a cantilever shelving system of Nexel Products, Inc., believed to be available to the public before Mar. 14, 2013, (11 pages).

Select components and views of a shelving system, Global Industrial (www.globalindustrial.com), produced by InterMetro Industries Corp in Case No. 13:18-cv-00116, *SPG International, LLC* v. *InterMetro Industries Corp* (19 pages).

(56) References Cited

OTHER PUBLICATIONS

"Cantilever Racks," All American Rack Company Warehouse Pallet Rack & Shelving (www.aarack.com/cantilever-racks/cantilever-racks/), produced by InterMetro Industries Corp in Case No. 13:18-cv-00116, *SPG International, LLC* v. *InterMetro Industries Corp* (2 pages).
"E-Z Walk-In Cooler/Freezer Shelving Systems," E-Z Shelving Systems, Inc., Merriam, KS, May 7, 2016, produced by InterMetro Industries Corp in Case No. 13:18-cv-00116, *SPG International, LLC* v. *InterMetro Industries Corp* (8 pages).
"E-Z Shelving Systems Basic Components," E-Z Shelving Systems, Inc., Merriam, KS, produced by InterMetro Industries Corp in Case No. 13:18-cv-00116, *SPG International, LLC* v. *InterMetro Industries Corp* (1 page).
"E-Z for 50 Years, Cantilever Shelving & Hardware," E-Z Shelving Systems, Inc., Merriam, KS, catalog, 2008, produced by InterMetro Industries Corp in Case No. 13:18-cv-00116, *SPG International, LLC* v. *InterMetro Industries Corp* (4 pages).
"Cantilever," unreferenced image, produced by InterMetro Industries Corp in Case No. 13:18-cv-00116, *SPG International, LLC* v. *InterMetro Industries Corp* (1 page).
"Quick Change Cantilever System," New Age Industrial Corp., Inc., Norton, Kansas, produced by InterMetro Industries Corp in Case No. 13:18-cv-00116, *SPG International, LLC* v. *InterMetro Industries Corp* (2 pages).
"Pick Racks, Trucks & Cantilever Shelving," produced by InterMetro Industries Corp in Case No. 13:18-cv-00116, *SPG Intemational, LLC* v. *InterMetro Industries Corp* (1 page).
"Metro Workspace Adjustable Workstations", InterMetro Industries Corporation, Wilkes-Barre, PA, 2001, produced by InterMetro Industries Corp in Case No. 13:18-cv-00116, *SPG International, LLC* v. *InterMetro Industries Corp* (4 pages).
"Sandwich Unit Refrigerator Model: SW48-12," Continental Refrigerator, Bensalem, PA, catalog, 2013, produced by InterMetro Industries Corp in Case No. 13:18-cv-00116, *SPG International, LLC* v. *InterMetro Industries Corp* (2 pages).
"Cantilever Metal Storage System," E-Z Shelving Systems, Inc., Merriam, KS, Product Guide Specification, Aug. 2011 (21 pages).
"Foodservice Cantilever Metal Storage System," E-Z Shelving Systems, Inc., Merriam, KS, Product Guide Specification, Aug. 2011 (19 pages).
"Shelving," New Age Industrial (www.newageindustrial.com:80/CategoryDetail.aspx?ISC_Category=Shelving), 2008 (1 page).
"New Age Industrial Aluminum Solutions," New Age Industrial Corporation, Inc., catalog, 2012 (72 pages).
"Sandwich Unit Refrigerator Model: SW48-12M-FB-D," Continental Refrigerator, Bensalem, PA, catalog, 2013 (2 pages).
"Sandwich Unit Refrigerator Model: SW48-12-FB," Continental Refrigerator, Bensalem, PA, catalog, 2013 (2 pages).
"Cantilever Shelving—New Age Industrial," (www.newageindustrial.com/PublicStore/Catalog/CategoryInfo.aspx?cid=191&sort=Name&itemsperpage=36&view=Grid&currentpage=1) (11 pages).
"New Age Industrial—Cantilevered Shelving," YouTube page, Apr. 16, 2011 (www.youtube.com/watch?v=Jm5aMXPcTsI) (2 pages).
Exhibit A, "Asserted Claims 1, 2, 3, 5, 7, 9, 11, 12, 14 and 16 of U.S. Pat. No. 9,883,755 are Invalid in View of Karnes," submitted by InterMetro Industries Corp in Case No. 13:18-cv-00116, *SPG International, LLC* v. *InterMetro Industries Corp*, (18 pages).
Exhibit B, "The Asserted Claims of U.S. Pat. No. 9,883,755 are Invalid Over Jensen et al. in View of Kessel et al.," submitted by InterMetro Industries Corp in Case No. 13:18-cv-00116, *SPG International, LLC* v. *InterMetro Industries Corp*, (26 pages).
Exhibit C, "The Asserted Claims of U.S. Pat. No. 9,883,755 are Invalid Over Jensen et al. in View of Mason," submitted by InterMetro Industries Corp in Case No. 13:18-cv-00116, *SPG International, LLC* v. *InterMetro Industries Corp*, (26 pages).
Exhibit D, "The Asserted Claims of U.S. Pat. No. 9,883,755 are Invalid Over Andersson et al. in View of Kessel et al.," submitted by InterMetro Industries Corp in Case No. 13:18-cv-00116, *SPG International, LLC* v. *InterMetro Industries Corp*, (26 pages).
Exhibit E, "The Asserted Claims of U.S. Pat. No. 9,883,755 are Invalid Over Andersson et al. in View of Mason," submitted by InterMetro Industries Corp in Case No. 13:18-cv-00116 *SPG International LLC* v. *InterMetro Industries Corp*, (26 pages).
Exhibit F, "Asserted Claims 1-3, 5, 7-12, 14-16 and 18 of U.S. Pat. No. 9,883,755 are Invalid under 35 U.S.C. § 112," submitted by InterMetro Industries Corp in Case No. 13:18-cv-00116, *SPG International, LLC* v. *InterMetro Industries Corp*, (10 pages).
Defendant InterMetro Industries Corp.'s Invalidity Contentions, U.S. District Court, Middle District of Tennessee Nashville Division, *SPG International, LLC* v. *Intermetro Industries Corp*, Case No. 13:18-cv-00116, (28 pages).
"Button-On Cantilever Rack Specification," webpage, https://web.archive.org/web/20061019070526/http://www.jarke.com/pro . . . ; Jarke, Prospect Heights, IL, 2006, produced by InterMetro Industries Corp in Case No. 13:18-cv-00116, *SPG International, LLC* v. *InterMetro Industries Corp*, (3 pages).
"Cantilevered Shelving System—Heavy Duty Components," Eagle Group, Clayton, DE, specification sheet, 2010, produced by InterMetro Industries Corp in Case No. 13:18-cv-00116, *SPG International, LLC* v. *InterMetro Industries Corp*, (2 pages).
"Cantilever Shelving," Eagle Group, Clayton, DE, catalog, 2005, produced by InterMetro Industries Corp in Case No. 13:18-cv-00116, *SPG International, LLC* v. *InterMetro Industries Corp*, (4 pages).
"Chapter 3—Installing FlexWorks Accessories," Lista International Corporation, Holliston, MA, guide, 2000, produced by InterMetro Industries Corp in Case No. 13:18-cv-00116, *SPG International, LLC* v. *InterMetro Industries Corp*, (14 pages).
"FreedomRail Installation Guide," Organized Living, Cincinnati, OH, guide, 2009, produced by InterMetro Industries Corp in Case No. 13:18-cv-00116, *SPG International, LLC* v. *InterMetro Industries Corp*, (3 pages).
"HD Super Work Center With Overhead," InterMetro Industries Corporation, Wilkes-Bane, PA, specification sheet, 1999, produced by InterMetro Industries Corp in Case No. 13:18-cv-00116, *SPG International, LLC* v. *InterMetro Industries Corp*, (2 pages).
"Shelving and Shelving Solutions," Eagle Group, Clayton, DE, catalog, 2009, produced by InterMetro Industries Corp in Case No. 13:18-cv-00116, *SPG International, LLC* v. *InterMetro Industries Corp*, (16 pages).
"Material Handling and Industrial Storage Solutions," SPG International, LLC, Covington, GA, Catalog, 2010, produced by InterMetro Industries Corp in Case No. 13:18-cv-00116, *SPG International, LLC* v. *InterMetro Industries Corp*, (27 pages).
"Super Erecta Shelf Post-Type and Direct Wall Mounts," InterMetro Industries, Wilkes-Bane, PA, specification sheet, 2000, produced by InterMetro Industries Corp in Case No. 13:18-cv-00116, *SPG International, LLC* v. *InterMetro Industries Corp*, (2 pages).
"Wire Basket with Brackets 36" × 16," Global Equipment Company, Inc., https://web.archive.org/web/20120507140028/http://www.globalindustria\'85; web page 2012, produced by InterMetro Industries Corp in case No. 13:18-cv-0016, *SPG International, LLC* v. *InterMetro Industries Corp*, (3 pages).
Extended European Search Report for Application No. 18156976.5, dated May 15, 2018, European Patent Office, produced by InterMetro Industries Corp in Case No. 13:18-cv-00116, *SPG International, LLC* v. *InterMetro Industries Corp*, (4 pages).
"Corrosion Resistant Cantilever Rack—Adjustable Width Uprights & Frame (Only)," Global Industrial, 2011, Port Nashington, NY, produced by InterMetro Industries Corp in Case No. 13:18-cv-00116, *SPG International, LLC* v. *InterMetro Industries Corp*., (12 pages).
"Cantilever Shelving Unit Assembly Instruction," Nexel Industries, instruction sheet, assumed publicly available prior to 2011, produced by InterMetro Industries Corp in Case No. 13:18-cv-00116,*SPG International, LLC* v. *InterMetro Industries Corp*, (2 pages).
"Freestyle Modular Cantilever Shelving System," SPG International, LLC, Covington, GA, specification, 2016, produced by InterMetro Industries Corp in Case No. 13:18-cv-00116, *SPG International, LLC* v. *InterMetro Industries Corp*, (9 pages).

(56) References Cited

OTHER PUBLICATIONS

International Search Report and Written Opinion received in International Patent Application No. PCT/US2014/058308, dated Jan. 5, 2015, produced by InterMetro Industries Corp in Case No. 13:18-cv-00116, *SPG International, LLC* v. *InterMetro Industries Corp*, (9 pages).
First Office Action and Search Report from The State Intellectual Property Office of the People's Republic of China for Application No. 201480060558.7, dated Jun. 27, 2017, produced by InterMetro Industries Corp in Case No. 13:18-cv-00116, *SPG International, LLC* v. *InterMetro Industries Corp*, (10 pages).
Extended European Search Report for Application No. 14851078.7, dated Jun. 28, 2017, produced by InterMetro Industries Corp in Case No. 13:18-cv-00116, *SPG International, LLC* v. *InterMetro Industries Corp*, (8 pages).
U.S. Appl. No. 15/673,119, filed Aug. 9, 2017, Arturo Gonzalez et al., entitled "Support Bracket," produced by InterMetro Industries Corp in Case No. 13:18-cv-00116, *SPG International, LLC* v. *InterMetro Industries Corp*, (25 pages).
U.S. Appl. No. 15/678,909, filed Aug. 16, 2017, Arturo Gonzalez et al., entitled "Support Bracket," produced by InterMetro Industries Corp in Case No. 13:18-cv-00116, *SPG International, LLC* v. *InterMetro Industries Corp*, (23 pages).
Office Action received in U.S. Appl. No. 14/840,254, dated Sep. 29, 2017, produced by InterMetro Industries Corp in Case No. 13:18-cv-00116, *SPG International, LLC* v. *InterMetro Industries Corp*, (8 pages).
Office Action received in U.S. Appl. No. 15/673,119, dated Oct. 2, 2017, produced by InterMetro Industries Corp in Case No. 13:18-cv-00116, *SPG International, LLC* v. *InterMetro Industries Corp*, (14 pages).
Office Action received in U.S. Appl. No. 15/678,909, dated Oct. 6, 2017, produced by InterMetro Industries Corp in Case No. 13:18-cv-00116, *SPG International, LLC* v. *InterMetro Industries Corp*, (20 pages).
Extended European Search Report for Application No. 147750810, dated Feb. 15, 2017, produced by InterMetro Industries Corp in Case No. 13:18-cv-00116, *SPG International, LLC* v. *InterMetro Industries Corp*, (8 pages).
First Office Action and Search Report from the State Intellectual Property Office of The People's Republic of China for Application No. 21480024336.X, dated Dec. 28, 2016, produced by InterMetro Industries Corp in Case No. 13:18-cv-00116, *SPG International, LLC* v. *InterMetro Industries Corp*, (16 pages).
"Metro Cantilevered Freestanding Shelving System," InterMetro Industries Corp., article, Wilkes-Barre, PA, 1993, produced by InterMetro Industries Corp in Case No. 13:18-cv-00116, *SPG International, LLC* v. *InterMetro Industries Corp*, (5 pages).
"Material Handling and Industrial Storage Solutions," SPG International, LLC, Covington, GA, Catalog, 2010, (97 pages).

* cited by examiner

SHELVING SUPPORT BRACKET ASSEMBLY

FIELD OF THE INVENTION

The present invention relates to support brackets, and more particularly to support brackets for shelving systems.

BACKGROUND

Strength and reliability are important issues relevant to shelving systems. In many conventional shelving system designs, a tradeoff exists between strength and reliability and other features, including manufacturability, material costs, and adjustability. Often times, individual shelves experience loading conditions that cause them to fail prematurely. Examples of failure include plastic (i.e., non-elastic) deformation due to bending or buckling, dynamic fracture, and fatigue-induced fracture. Cantilevered shelves are particularly susceptible to these types of failure when subjected to repeated impact loading, for example, when heavy loads are dropped onto the shelf from an appreciable height. Such failure leads to undesirable downtime, repair, or replacement, and the costs associated therewith.

SUMMARY

In one embodiment a shelving system includes a support post having a mounting surface and a plurality of vertically spaced retention members extending from the mounting surface. A shelf includes a bracket member configured for coupling to a first of the vertically spaced retention members. A support bracket includes an attachment portion configured for coupling to a second of the vertically spaced retention members adjacent the first vertically spaced retention member and a support portion configured for coupling to the bracket member.

In one embodiment of a support bracket for a shelving system having a support post with a plurality of retention members extending therefrom and a shelf having a bracket member configured for coupling to a first of the plurality of retention members, wherein the shelf further includes a support member secured to the bracket member, the support bracket includes an attachment portion configured for coupling to a second of the plurality of retention members, in which the second retention member is adjacent the first retention member. The support bracket further includes a support portion extending from the attachment portion and formed to be disposed substantially about the support member.

In one embodiment a shelving system includes a support post having a mounting surface and a plurality of vertically spaced retention members extending from the mounting surface. A shelf includes a bracket member configured for coupling to a first of the vertically spaced retention members and a support member secured to the bracket member. A support bracket includes an attachment portion having an aperture therethrough formed to receive a second of the vertically spaced retention members, in which the second retention member is adjacent the first retention member. The support bracket further includes a support portion comprising a generally C-shaped region forming a recess. The C-shaped region is formed to be disposed substantially about and to couple to the support member.

In one embodiment of a support bracket for a shelving system having a support post with a plurality of retention members extending therefrom and a shelf having a bracket member configured for coupling to a first of the plurality of retention members, wherein the shelf further includes a support member secured to the bracket member, the support bracket includes an attachment portion configured for coupling to a second of the plurality of retention members, in which the second retention member is spaced from the first retention member along a length of the support post. The support bracket further includes a support portion extending from the attachment portion and configured for supporting the support member.

Other features and aspects of the invention will become apparent by consideration of the following detailed description and accompanying drawings.

DETAILED DESCRIPTION

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways. Also, it is to be understood that the phraseology and terminology used herein is for the purpose of description and should not be regarded as limiting.

Figure 1:
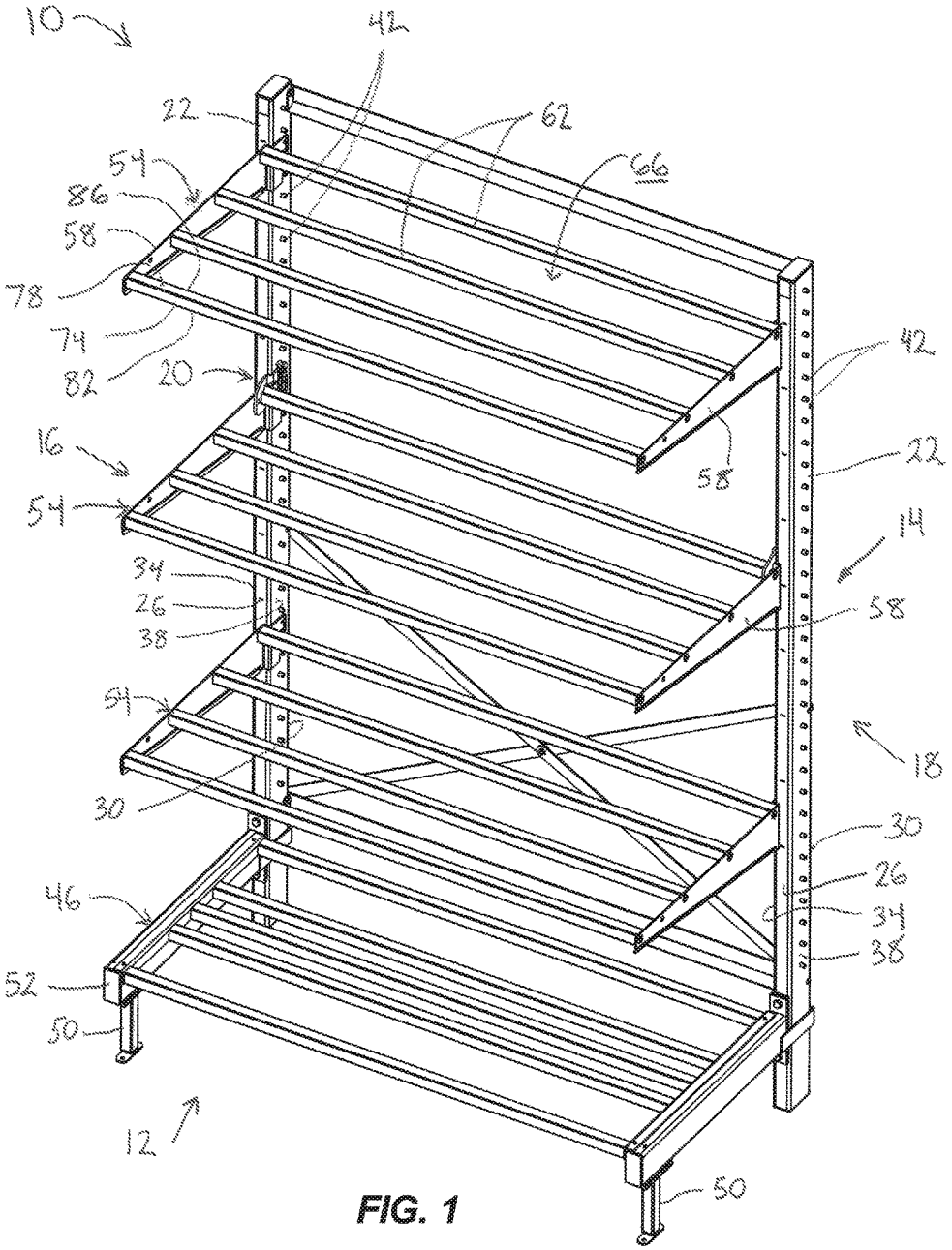
FIG. 1 is a perspective view of a shelving system including a support bracket.

FIG. 1 illustrates an exemplary shelving system 10 including one or more support brackets 20. The shelving system 10 is referenced herein with respect to a proximal end 12, a distal end 14, a left side 16, and a right side 18, the left and right sides 16, 18 referenced when viewed in the distal direction. The shelving system 10 includes a pair of vertical support posts 22 (i.e., left and right support posts 22) erected with respect to a ground or other support surface. Each post 22 defines a proximal side 26, a distal side 30, a left side 34, and a right side 38, and includes a plurality of vertically spaced retention members 42 in the form of support pins extending therethrough and protruding laterally from the left and right sides 34, 38. In the illustrated embodiment, the support pins 42 are spaced a distance of between about one inch and about four inches along the length of each post 22. In other embodiments, the support pins 42 can be spaced equally or unequally from each other. Each pin 42 is preferably press-fit in place but can be secured in any suitable manner generally known to those of skill in the art, e.g., welding, etc. In additional embodiments, the retention members can be in the form of hooks, ledges, or other shaped protrusions and forms affixed or otherwise coupled to each post 22.

A bottom shelf 46 nearest the ground or other support surface extends from the proximal side 26 of the posts 22 and includes a pair of support legs 50 at or near an end 52 that contacts the ground or other support surface to provide stability for the shelving system 10.

With continued reference to FIG. 1, the shelving system 10 includes one or more shelves 54 configured for coupling to the support posts 22. Each shelf 54 is mounted to the posts 22 by way of the support pins 42 and includes lateral brackets 58 with a plurality of support members 62 in the form of cross-braces extending therebetween to provide a generally planar support surface 66 for the shelf 54. Each of the support members 62 includes a proximal side 74 substantially perpendicular to the planar support surface 66, a top side 78 adjacent the planar support surface 66, a bottom side 82 opposite the top side 78, and a distal side 86 opposite the proximal side 74. As such, the illustrated support members 62 have a generally rectangular cross-section. However, other embodiments of a shelf 54 can include support members 62 having any other regularly or irregularly shaped cross-section, while still maintaining generally designated sides. For example, a support member having a circular cross-section (not shown) is oriented by definition to include top, bottom, front, and rear sides despite not having distinct surfaces separated by corners. In yet other embodiments, the lateral brackets 58 can be connected by a frame, sheet, series of bars or poles, mesh, screen, grate, or other form of support member extending between the lateral brackets 58 for purposes of supporting weight, through either direct contact or optionally through a separate supporting surface cover or platform upon which to store and/or display articles.

Figure 2:
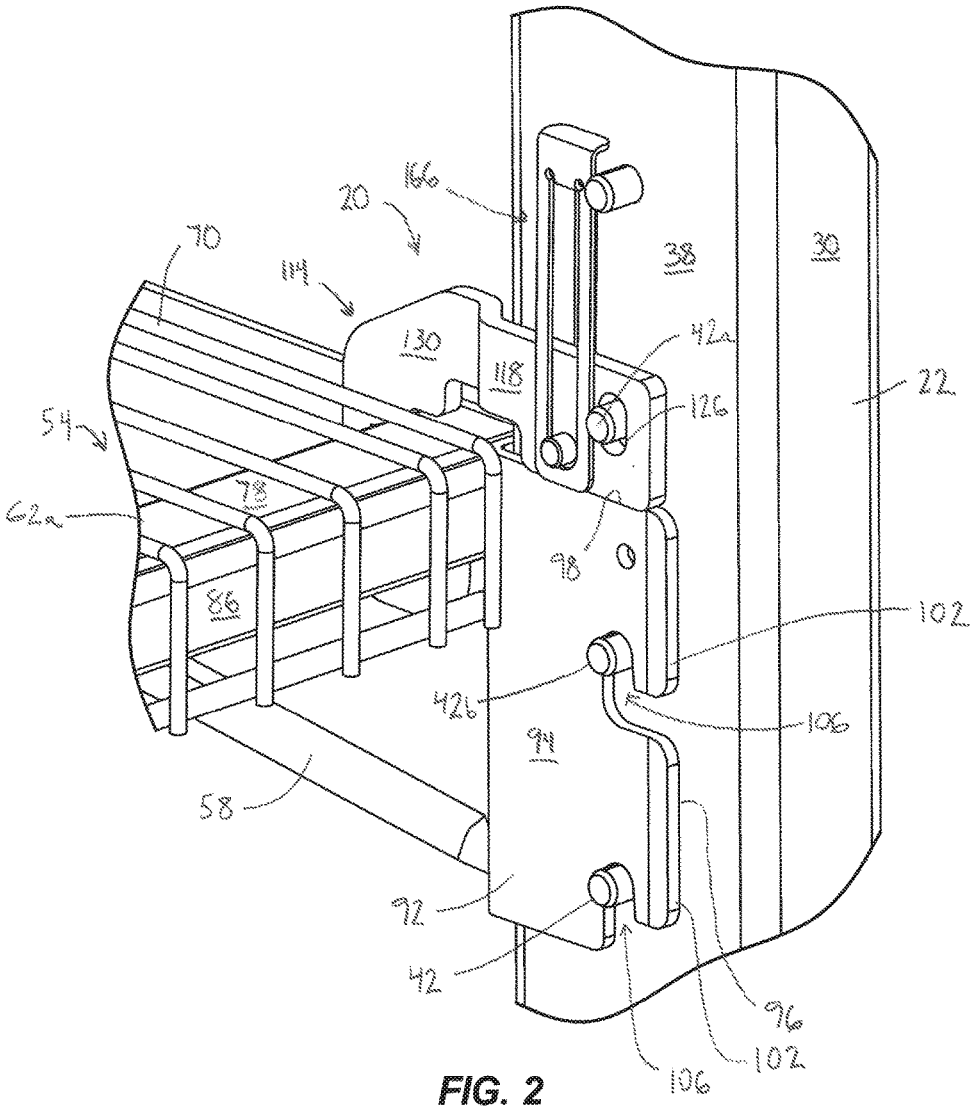
FIG. 2 is a partial perspective view of the shelving system showing the bracket identified in FIG. 1.
Figure 3:
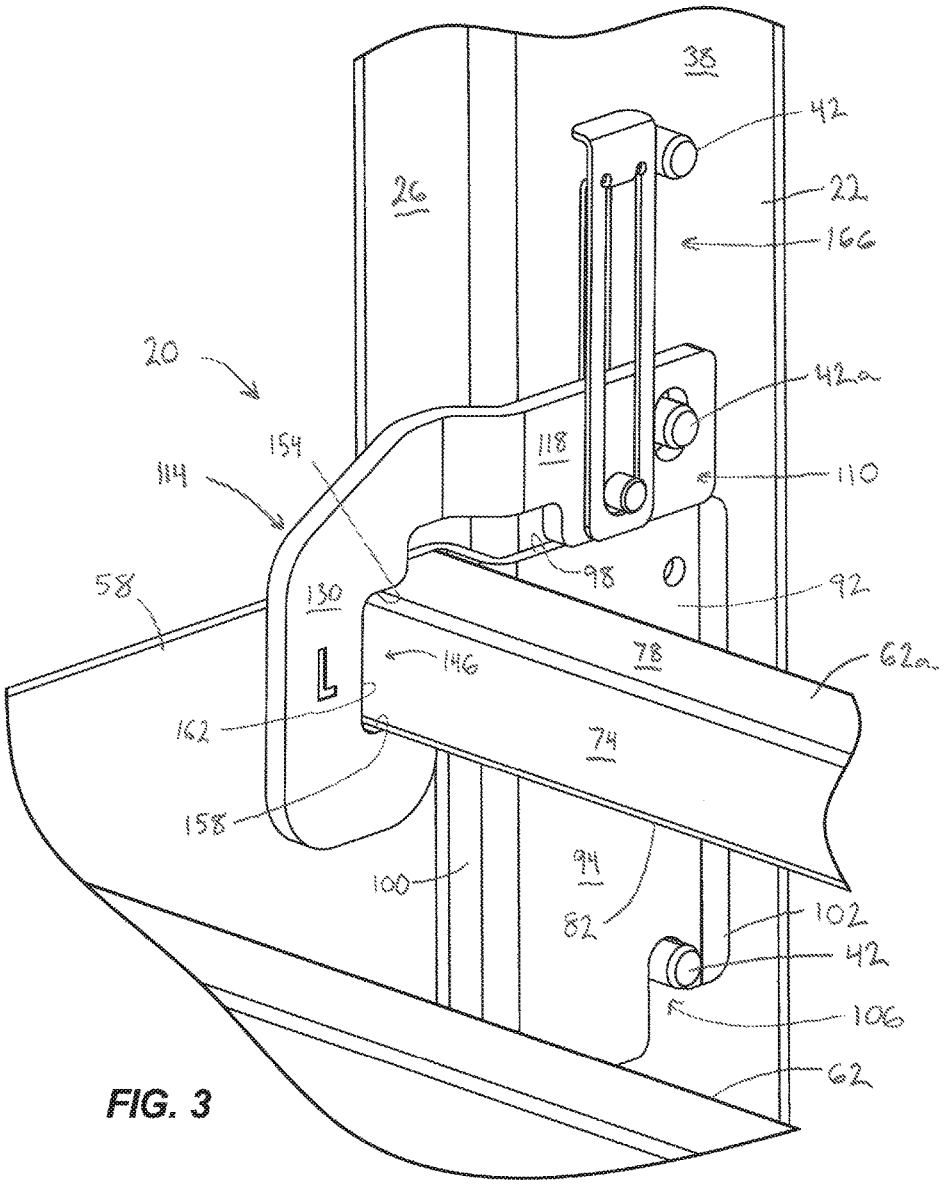
FIG. 3 is another partial perspective view of the shelving system showing the bracket identified in FIG. 1.

Referring to FIGS. 2 and 3, each of the lateral brackets 58 includes a flange member 92 having a first side 94 opposite the support post 22 when coupled thereto, a second side 96 adjacent the support post 22, and a top side 98 extending between the first side 94 and the second side 96. The flange member 92 also includes a bearing surface 100 adjacent and generally parallel to the proximal side 26 of the support post 22. Contact between the bearing surface 100 and the proximal side 26 prevents rotation of the shelf 54 on the post 22 due to the weight of the shelf 54 and additional loading placed upon the support members 62.

In the illustrated embodiment, the flange members 92 include a plurality of distally-extending fingers 102 or hooks that curve downward to form recesses 106. The recesses 106 each receive and removably secure a pin 42 to mount the shelf 54 to the post 22, preventing translational and rotational movement of the shelf due to loading forces. The fingers 102 or hooks can be equally or unequally spaced but are positioned to correspond to the support pins 42.

Figure 7:
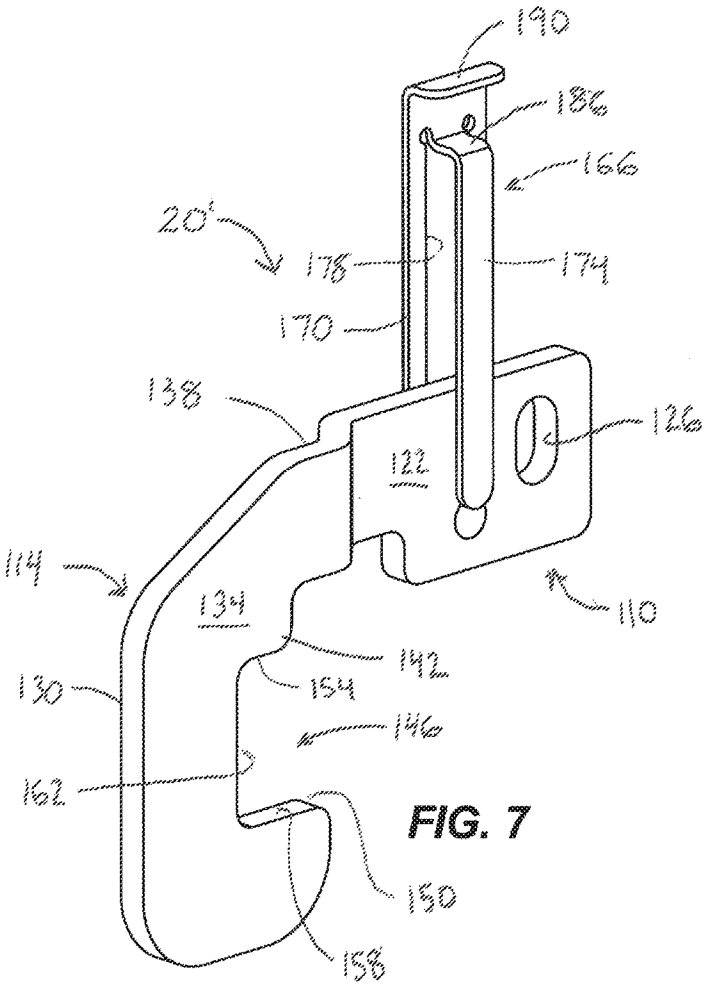
FIG. 7 is another perspective view of the support bracket of FIG. 6.

The support bracket 20, to be hereinafter described with reference to FIGS. 2-5, 8, and 9, is configured as a left-side bracket for coupling generally to the left side 16 of the shelving system 10. FIGS. 6 and 7 illustrate another support bracket 20' configured as a right-side support bracket for coupling generally to the right side of the shelving system 10. In other embodiments, the support brackets 20, 20' can be incorporated into the shelving system individually (e.g., for a shelving system having a single support post). The support bracket 20' of FIGS. 6 and 7 is a mirror image of the support bracket 20. As such, the support bracket 20' will not be described in detail herein, and like features of the support brackets 20 and 20' have been given like reference numerals.

Although the support bracket 20 is described with respect to the shelving system 10 illustrated in FIG. 1, it should be understood that various embodiments of the support bracket 20 can be used with other types of shelving systems.

The support bracket 20 includes an attachment portion 110 and a support portion 114 continuously extending from the attachment portion 110. The attachment portion 110 includes a first side 118, a second side 122 opposite the first side 118, and an aperture 126 extending from the first side 118 to the second side 122. The aperture 126 is configured to receive a pin 42 projecting from the post 22 to couple the attachment portion 110 to the post 22. In other embodiments, the attachment portion 110 can be sized to include two or more apertures 126 to receive two or more pins 42 of the post 22. Alternative engagement features for coupling the attachment portion 110 with the post 22 or with posts of other shelving systems are within the scope of the present invention.

In the illustrated embodiment, the support bracket 20 is positioned on the post 22 with the second side 122 of the attachment portion 110 generally parallel and adjacent to the post 22, specifically the right side 38 of the post 22 (or the left side 34 for a support bracket 20'). The attachment portion 110 is positioned vertically adjacent the flange member 92 of a lateral bracket 58, and the aperture 126 of the attachment portion 110 receives the pin 42*a* adjacent the pin 42*b* engaged with the fingers 102 on the flange member 92, as illustrated in FIG. 2. As such, a portion of the support bracket 20 is positioned directly above the shelf 54. As shown in FIGS. 2 and 3, the attachment portion 110 abuts the top side 98 of the flange member 92, but in other embodiments, the attachment portion 110 can be spaced from the top side 98 of the flange member 92 and need not receive the pin adjacent the pin 42*b* (e.g., dependent on the spacing of the pins 42, the position of the aperture 126, or the shape of the attachment portion 110). In yet other embodiments, by varying the connection of the attachment portion 110 to the support portion 114, the support bracket 20 can be coupled to the post 22 such that the second side 122 of the attachment portion 110 is positioned laterally adjacent the flange member 92. In such an embodiment, the attachment portion 110 and the flange member 92 can be coupled to the same pin(s) 42.

Figure 5:
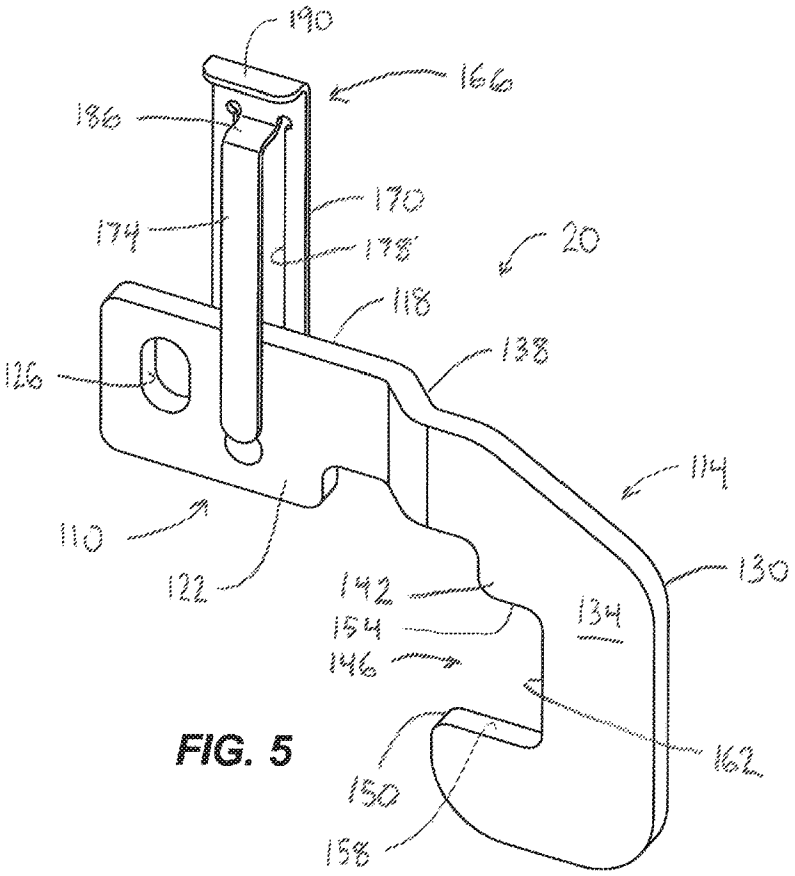
FIG. 5 is another perspective view of the support bracket of FIG. 2.
Figure 4:
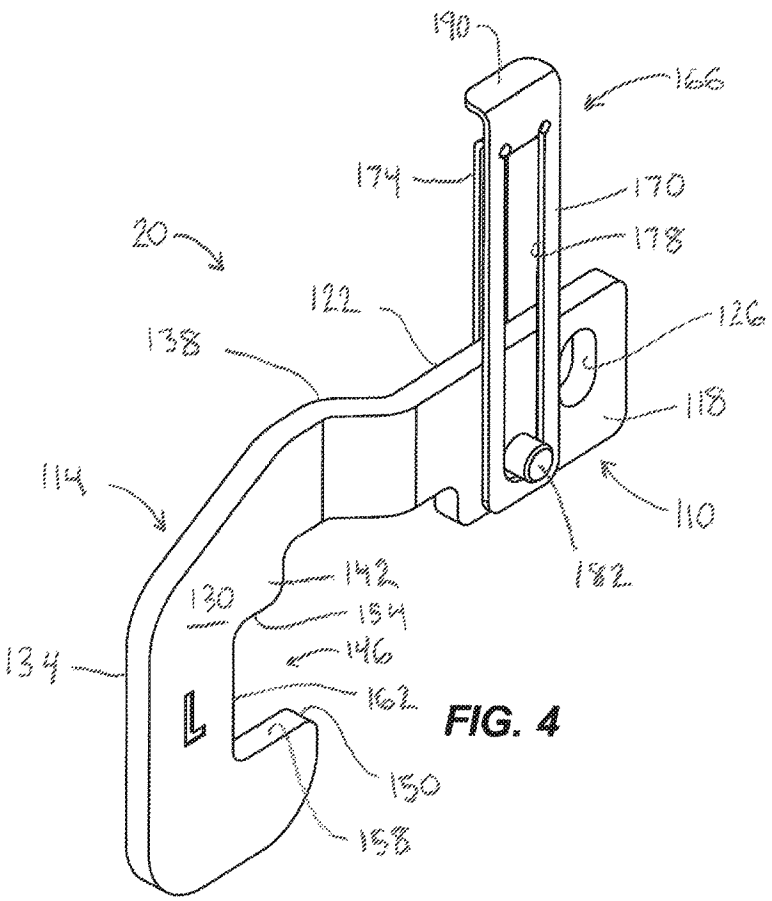
FIG. 4 is a perspective view of the support bracket of FIG. 2.
Figure 6:
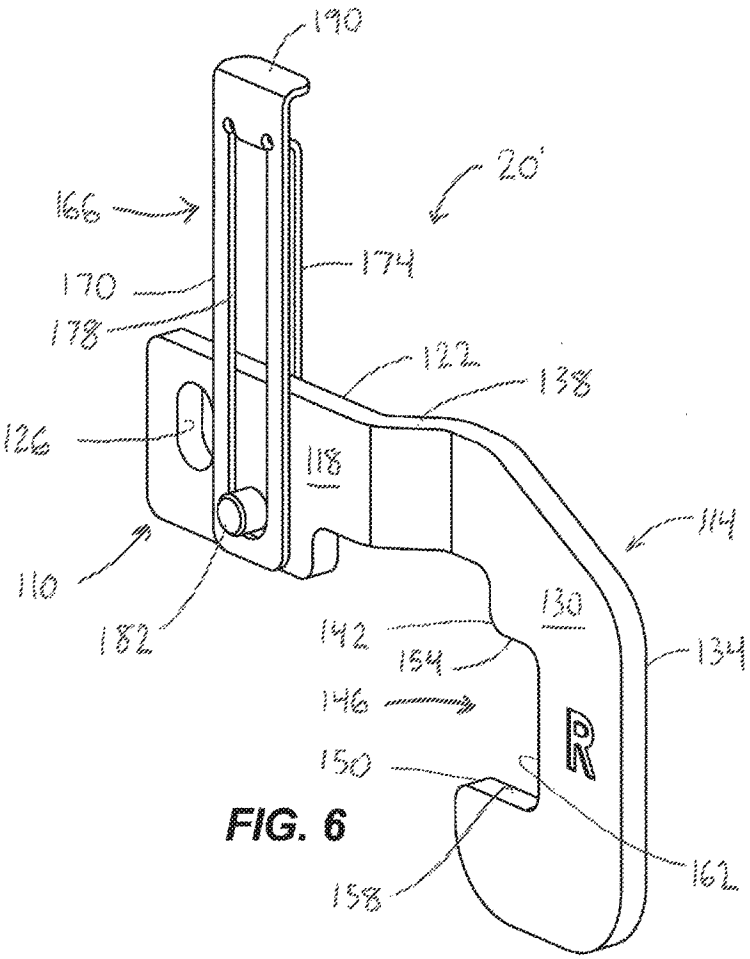
FIG. 6 is a perspective view of another support bracket for use with the shelving system of FIG. 1.
Figure 9:
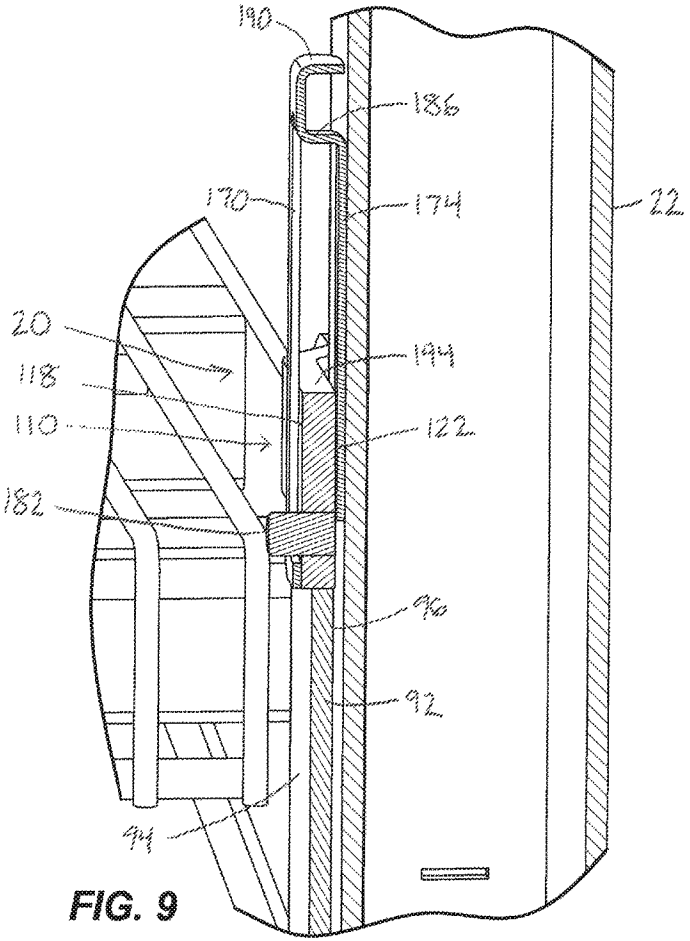
FIG. 9 is a cross-sectional view of a portion of the shelving system of FIG. 1, showing the lock member of the support bracket in an unlocked position.

Referring to FIGS. 4 and 5, the support portion 114 includes a first side 130 substantially parallel with the first side 118 of the attachment portion 110, and a second side 134 opposite the first side 130. A curved transition region 138 offsets the attachment portion 110 from the support portion 114. In other embodiments, the first and second sides 130, 134 of the support portion 114 can be generally coplanar with the first and second sides 118, 122 of the attachment portion 110. The support portion 114 further includes a generally C-shaped region 142 extending downward from the support portion (relative to the orientation of FIGS. 4 and 5). The C-shaped region 142 forms a recess 146 having an opening 150 oriented toward the attachment portion 110. The recess 146 is further defined by an upper wall 154, a lower wall 158, and an intermediate wall 162 extending between the upper wall 154 and the lower wall 158. The walls 154, 158, and 162 are configured to engage the distal support member 62*a* of the shelf 54 (when mounted to the post 22). Accordingly, in other embodiments, the recess 146 can have other shapes and/or orientations suitable to engage with the support member 62*a* or other shaped or sized member extending between lateral brackets 58 and supporting or otherwise forming the support surface cover or platform 66 upon which to store and/or display articles. For example, in some embodiments, the recess 146 can include a single curved wall to engage with a support member having a circular cross-section. In other embodiments with alternative mounting of the attachment portion 110, the C-shaped region 142 can extend upward from the support portion 114 to engage the support member 62*a*.

With reference to FIG. 3, the recess 146 of the support portion 114 is disposed about a portion of the distal support member 62*a* of the shelf 54 to engage and secure or otherwise support the support member 62*a* when the support bracket 20 is installed on the post 22. The upper wall 154 is positioned adjacent the top side 78 of the distal support member 62*a*, the intermediate wall 162 is positioned adjacent the proximal side 74 of the distal support member 62*a*, and the lower wall 158 is positioned adjacent the bottom side 82 of the distal support member 62*a*, i.e., the support portion 114 is disposed substantially about the support member 62*a*. At least one of the sides (e.g., the bottom side 82 and/or the proximal side 74) of the distal support member 62*a* contacts or bears against the adjacent wall (i.e., the lower 158 and/or intermediate wall 162) to transmit loading from the lateral bracket 58 through the distal support member 62*a* to the support bracket 20. The support bracket 20 then transmits this loading to the support post 22. Accordingly, the support bracket 20 reduces the stresses experienced by the lateral bracket 58 and strengthens the shelving system 10.

The support brackets 20, 20' are preferably formed from a single piece of metal, for example, by a stamping or cutting process.

Referring to FIGS. 4, 5, 8, and 9, the support bracket 20 includes a lock member 166 slidable relative to the support bracket 20 between an unlocked position (FIG. 9) in which the lock member 166 permits movement of the support bracket 20 relative to the flange member 92 and a locked position (FIG. 8) in which the lock member 166 inhibits movement of the support bracket 20 relative to the flange member 92. The lock member 166 includes a first leg 170 adjacent the first side 118 of the attachment portion 110 and a second leg 174 adjacent the second side 122 of the attachment portion 110. The first leg 170 includes a slot 178 extending therethrough, which receives a laterally extending projection 182 of the attachment portion 110 to couple the lock member 166 to the attachment portion 110. The slot 178 is slidable along the projection 182 as the lock member 166 moves between the locked position and the unlocked position. The lock member 166 also includes a connecting portion 186 extending between the first and second legs 170, 174, and an upper surface 190 extending generally perpendicular to the legs 170, 174 to facilitate positioning of the lock member 166. In the illustrated embodiment, the lock member 166 is integrally formed from a single piece of metal. For example, the second leg 174 can be stamped or cut from the first leg 170 to thereby define the slot 178, then bent to laterally offset the second leg 174 from the first leg 170, forming the connecting portion 186. In other embodiments, the lock member 166 can be formed from multiple pieces and/or through any suitable process.

Figure 8:
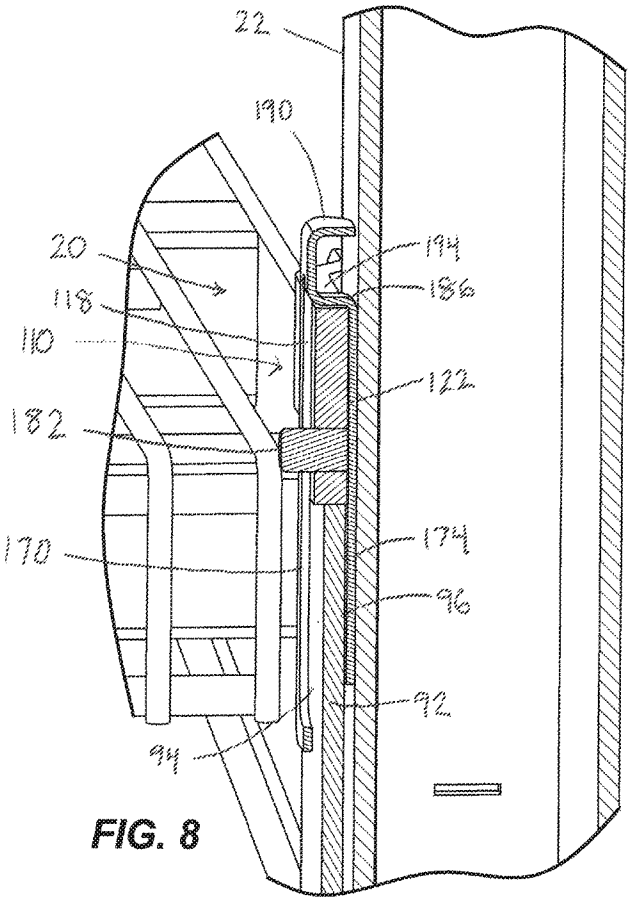
FIG. 8 is a cross-sectional view of a portion of the shelving system of FIG. 1, showing a lock member of the support bracket in a locked position.

With reference to FIG. 8, in the locked position, the connecting portion 186 of the lock member 166 abuts a top side 194 of the attachment portion 110 to provide an indication that the lock member 166 is fully engaged in the locked position. In the locked position of FIG. 8, the first leg 170 of the lock member 166 spans across both the first side 118 of the attachment portion 110 and the first side 94 of the flange member 92. Similarly, the second leg 174 of the lock member 166 spans across the second side of the attachment portion and the second side 96 of the flange member 92, disposed in the space defined between the surface 122 of bracket 20 and surface 96 of flange member 92, on the one hand, and the surface 38 of support post 22, on the other hand. As such, the attachment portion 110 and the flange member 92 are captured between the first and second legs 170, 174 of the lock member 166 and held in alignment. This prevents lateral movement of the support bracket 20 relative to the flange member 92 and keeps the bracket 20 in its optimal position for providing support to the shelf 54.

The support brackets 20 and 20' thereby assist in mitigating the mechanical stresses developed in the lateral brackets 58 due to shelf loading, such as impact loading, by providing a countering force to such loading. The support bracket can be readily installed without the need for any tools or external devices to new or existing shelving systems having a variety of different configurations, shelf depths, and lengths.

Various features of the invention are set forth in the following claims.

What is claimed is:

1. A shelving system comprising:

a support post having a mounting portion presenting a plurality of support pins and opposed first and second surfaces facing away from one another, wherein each support pin of the plurality of support pins is fixed to the support post and extends outwardly away from at least one of the opposed first and second surfaces;

a shelf;

a first bracket having a flange that defines a plane, the flange configured for releasable attachment with any one support pin of the plurality of support pins fixed to the support post, wherein the flange is configured such that in an assembled state of the shelving system the flange has a first side adjacent the support post and a second side opposite the first side, and a support portion extending from the flange and configured such that in the assembled state of the shelving system the support portion extends away from the support post in a longitudinal direction that is parallel to the plane, the support portion configured to support the shelf; and a second bracket having a flange that is configured for releasable attachment with any one support pin of the plurality of support pins fixed to the support post, wherein the second bracket is configured such that in the assembled state of the shelving system the flange of the second bracket is positioned adjacent the flange of the first bracket and a portion of the second bracket overlaps a portion of the second side of the flange of the first bracket to limit relative lateral movement between the first bracket and the second bracket.

2. The shelving system of claim 1, wherein the second bracket is configured such that in the assembled state of the shelving system the portion of the second bracket that overlaps the flange of the first bracket retains the second bracket on the support post.

3. The shelving system of claim 1, wherein the flange of the first bracket includes an aperture configured for releasable engagement with any one support pin of the plurality of support pins, and the flange of the second bracket includes an aperture configured for releasable engagement with any one support pin of the plurality of support pins.

4. The shelving system of claim 3, wherein the first bracket is configured such that in the assembled state of the shelving system the support portion of the first bracket supports a bottom side of the shelf above the aperture of the first bracket configured for releasable engagement with any one support pin of the plurality of support pins.

5. The shelving system of claim 1, wherein the support post includes a third surface between the opposed first and second surfaces, and wherein one of the first bracket and the second bracket is configured such that in the assembled state of the shelving system a portion of one of the first bracket and the second bracket extends across a portion of the third surface of the support post and the flange of the first bracket and the flange of the second bracket are positioned adjacent a same one of the opposed first and second surfaces of the support post.

6. The shelving system of claim 1, wherein the first bracket and the second bracket are configured such that in the assembled state of the shelving system the flange of the first bracket and the flange of the second bracket are in contact.

7. The shelving system of claim 1, wherein the first bracket and the second bracket are configured such that in the assembled state of the shelving system the first bracket and the second bracket engage a same one of the opposed first and second surfaces of the support post.

8. The shelving system of claim 1, wherein the second bracket is configured such that in the assembled state of the shelving system a portion of the second bracket extends below a top side of the first bracket.

9. The shelving system of claim 1, wherein the second bracket is configured such that in the assembled state of the shelving system a portion of the second bracket extends below a bottom side of the shelf.

10. A support bracket assembly for a shelving system having a support post with a mounting portion including a first surface and a second surface facing away from the first surface, a third surface between the first and second surfaces, a plurality of support pins fixed to the support post and each support pin extending away from one of the first and second surfaces, and a shelf for coupling to the support post, the support bracket assembly comprising:

a first bracket configured to support the shelf and including a flange configured for releasable attachment to one of the first and second surfaces of the support post, wherein the flange defines a plane and the first bracket is configured such that in an assembled state of the shelving system the flange is positioned adjacent to and extends along one of the first and second surfaces of the support post toward the shelf, wherein the flange is configured such that in an assembled state of the shelving system the flange has a first side adjacent the support post and a second side opposite the first side, and a support portion extending from the flange and configured such that in the assembled state of the shelving system the support portion extends away from the support post in a longitudinal direction that is parallel to the plane and is configured to support the shelf, wherein the flange includes an aperture configured to releasably engage any one support pin of the plurality of support pins; and a second bracket including a flange configured for releasable attachment to one of the first and second surfaces of the support post, wherein the second bracket is configured such that in the assembled state of the shelving system a portion of the second bracket extends over a portion of the second side of the flange of the first bracket to limit relative lateral movement between the first bracket and the second bracket, wherein the first bracket and the second bracket are configured such that in the assembled state of the shelving system the flange of the first bracket and the flange of the second bracket are positioned adjacent to and extend along a same one of the first and second surfaces of the support post, and wherein the flange of the second bracket includes an aperture configured to releasably engage any one support pin of the plurality of support pins.

11. The support bracket of claim 10, wherein the first bracket is configured such that in the assembled state of the shelving system the support portion of the first bracket supports a bottom of the shelf above the aperture of the flange of the first bracket configured to releasably engage any one support pin of the plurality of support pins.

12. The support bracket assembly of claim 10, wherein the first bracket is configured such that in the assembled state of the shelving system a top side of the support portion of the first bracket is positioned above the aperture of the flange of the first bracket configured to releasably engage any one support pin of the plurality of support pins.

13. A shelving system comprising:

a support post with a mounting portion including a first surface and a second surface facing away from the first surface, a third surface between the first and second surfaces and defining a first plane, a plurality of support pins fixed to the support post and each support pin extending away from one of the first and second surfaces;

a shelf for coupling to the support post;

a support bracket assembly configured to couple the shelf to the support post, the support bracket assembly including a first bracket configured to support the shelf and including a flange that defines a second plane, the flange configured for releasable attachment to one of the first and second surfaces of the support post, and a second portion extending from the flange and configured such that in an assembled state of the shelving system the second portion extends away from the support post in a longitudinal direction parallel to the second plane, the second portion configured to support the shelf, wherein the first bracket is configured such that in the assembled state of the shelving system the flange of the first bracket is positioned adjacent to and extends along one of the first and second surfaces of the support post toward the shelf, wherein the flange is configured such that in the assembled state of the shelving system the flange has a first side adjacent the support post and a second side opposite the first side, wherein the flange includes an aperture configured to releasably engage any one support pin of the plurality of support pins, and wherein the first bracket is configured such that in the assembled state of the shelving system the second portion supports the shelf above the aperture of the flange of the first bracket and hinders the shelf from moving in a direction orthogonal to the first plane, and a second bracket including a flange configured for releasable attachment to one of the first and second surfaces of the support post, wherein the first bracket and the second bracket are configured such that in the assembled state of the shelving system the flange of the first bracket and the flange of the second bracket are positioned adjacent to and extend along a same one of the first and second surfaces of the support post, wherein the second bracket is configured such that in the assembled state of the shelving system a portion of the second bracket covers a portion of the second side of the flange of the first bracket and limits relative lateral movement between the first bracket and the second bracket, and wherein the flange of the second bracket includes an aperture configured to releasably engage any one support pin of the plurality of support pins.

14. The shelving system of claim 13, wherein the second bracket is configured such that in the assembled state of the shelving system the second bracket captures a part of the flange of the first bracket.

15. The shelving system of claim 13, wherein the second bracket is configured such that in the assembled state of the shelving system a portion of the second bracket extends below a top side of the first bracket.

16. The shelving system of claim 13, wherein the second bracket is configured such that in the assembled state of the shelving system a portion of the second bracket extends below a bottom side of the shelf.

17. A support bracket assembly for a shelving system having a support post with a mounting portion, the mounting portion including a first surface and a second surface facing away from the first surface, a third surface between the first and second surfaces and defining a plane, a plurality of support pins fixed to the support post and extending away from the first and second surfaces, and a shelf for coupling to the support post, the support bracket assembly comprising:

a first bracket including a flange configured for releasable attachment to one of the first and second surfaces of the support post and having an aperture configured to releasably engage any one support pin of the plurality of support pins, wherein the first bracket is configured such that in an assembled state of the shelving system the flange is positioned adjacent to and extends along one of the first and second surfaces of the support post toward the shelf, wherein the flange is configured such that in the assembled state of the shelving system the flange has a first side adjacent the support post and a second side opposite the first side, the first bracket including a second portion extending from the flange, wherein the first bracket is configured such that in the assembled state of the shelving system the second portion supports the shelf above the aperture and hinders the shelf from moving in a direction orthogonal to the plane defined by the third of the support post; and a second bracket including a flange configured for releasable attachment to one of the first and second surfaces, wherein the second bracket is configured such that in the assembled state of the shelving system a portion of the second bracket extends over a portion of the second side of the flange of the first bracket and inhibits relative lateral movement between the first bracket and the second bracket, wherein the first bracket and the second bracket are configured such that in the assembled state of the shelving system the flange of the first bracket and the flange of the second bracket are positioned adjacent to and extend along a same one of the first and second surfaces of the support post, and wherein the flange of the second bracket includes an aperture configured to releasably engage any one support pin of the plurality of support pins.

18. The shelving system of claim 17, wherein the first bracket and the second bracket are configured such that in the assembled state of the shelving system a portion of the second bracket extends below a top side of the first bracket.

19. The shelving system of claim 17, wherein the second bracket is configured such that in the assembled state of the shelving system a portion of the second bracket extends below a bottom side of the shelf.

* * * * *